US007357370B2

(12) United States Patent
Chen

(10) Patent No.: US 7,357,370 B2
(45) Date of Patent: Apr. 15, 2008

(54) DETENT APPARATUS FOR WATER TEMPERATURE REGULATION OF INDUCTION FAUCETS

(76) Inventor: Jan Sun Chen, 3F., No. 42, Sing-Zhong Road, Nei-Hu, Taipei City, 114 (TW)

( * ) Notice: Subject to any disclaimer, the term of this patent is extended or adjusted under 35 U.S.C. 154(b) by 163 days.

(21) Appl. No.: 11/415,179

(22) Filed: May 2, 2006

(65) Prior Publication Data

US 2007/0256745 A1 Nov. 8, 2007

(51) Int. Cl.
*F16K 11/085* (2006.01)

(52) U.S. Cl. ..... 251/288

(58) Field of Classification Search ..... 137/625.41; 251/286, 288

See application file for complete search history.

(56) References Cited

U.S. PATENT DOCUMENTS 4,753,418 A * 6/1988 Brotcke ..... 251/288
5,950,982 A * 9/1999 Williams ..... 251/286
6,471,503 B1 * 10/2002 Priest et al. ..... 137/625.41
6,935,368 B1 * 8/2005 Lee ..... 137/625.47
7,188,641 B2 * 3/2007 Yang ..... 251/288
7,231,935 B2 * 6/2007 Huang ..... 251/288

* cited by examiner

*Primary Examiner*—John Fox
(74) *Attorney, Agent, or Firm*—Birch, Stewart, Kolasch & Birch, LLP

(57) ABSTRACT

A detent apparatus for water temperature regulation of induction faucets includes a mixer located in a faucet and a swiveling mechanism located in the mixer. The swiveling mechanism has a rotary valve and a handle located outside the mixer and the faucet. The handle is fastened to an end seat located on one end of the rotary valve through a coupling member. The detent apparatus includes a detent portion preferably formed integrally with the mixer and located on the outer surface of the mixer body in a protrusive manner. The detent portion has a top end surface spaced beneath a bucking portion of the end seat at a selected distance. When the end seat is swiveled the bucking portion hits a left bucking angle or a right bucking angle of the top end surface thereby the swiveling angle of the end seat is confined within a limited range.

2 Claims, 4 Drawing Sheets

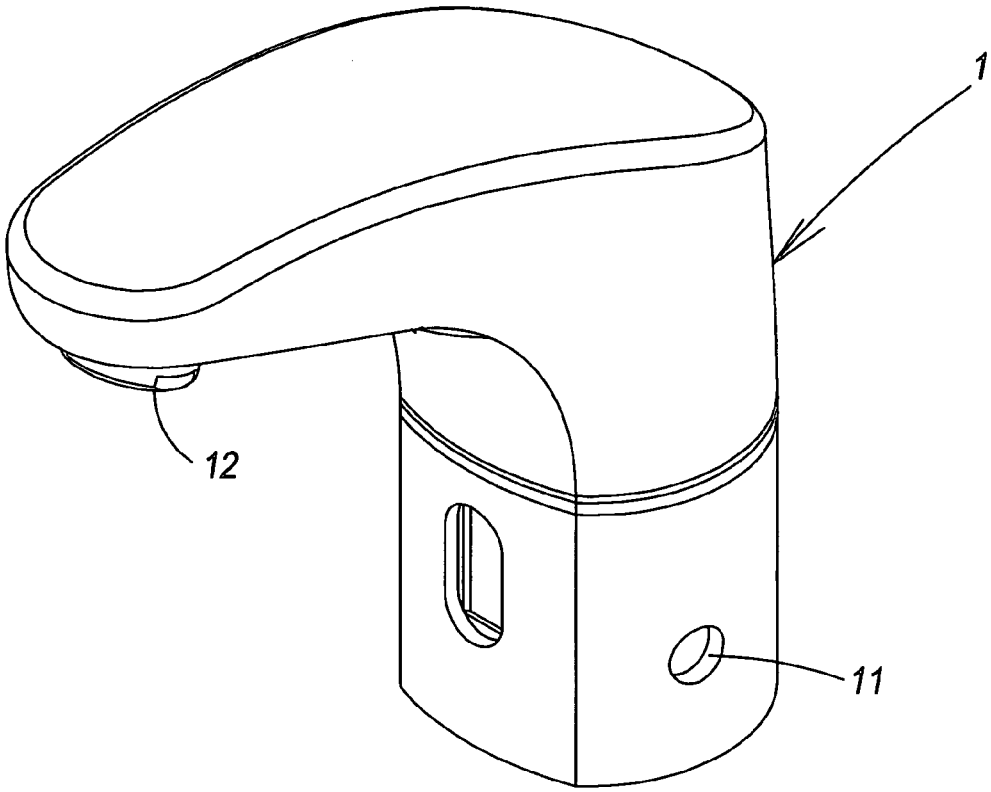
FIG.2
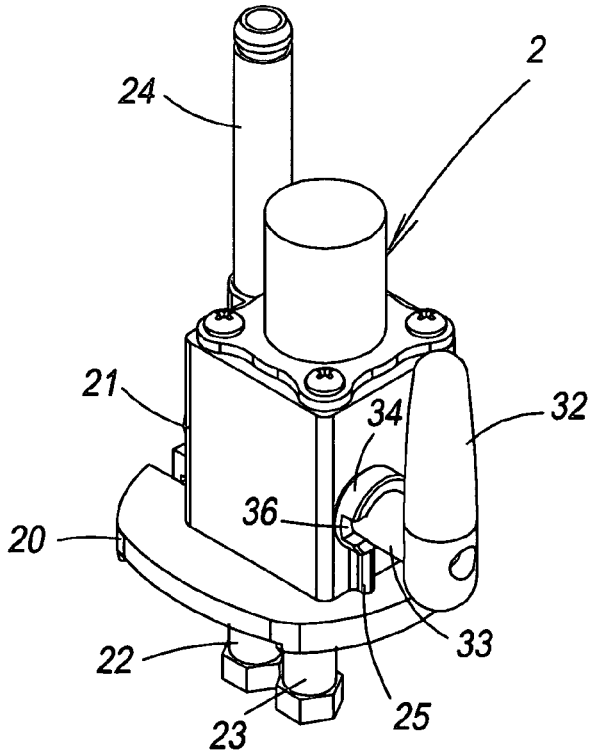

DETENT APPARATUS FOR WATER TEMPERATURE REGULATION OF INDUCTION FAUCETS

BACKGROUND OF THE INVENTION

1. Field of the Invention

The present invention relates to a detent apparatus for water temperature regulation of induction faucets and particularly to an apparatus for induction faucets to manually adjust water discharge temperature that has two detent limits to confine swiveling of a water temperature regulation means and can be formed easily.

2. Description of the Prior Art

The water discharge controllers of automatic induction faucets now available on the market commonly adopt a magnetic switch (solenoid valve) to control water discharge and amount by automatically detecting the presence of users without touching or depressing a handle. Such types of faucets are more sanitary and also can save water consumption. However, such a feature also makes control of water temperature by mixing cold and hot water more difficult than the conventional faucets. Hence they mostly aim to deliver cold water.

On the other hand, in some special occasions such as laboratories, hospitals and the like regulating water temperature is necessary. To meet this requirement an automatic induction faucet capable of regulating water discharge temperature has been developed. It mainly includes an induction device to control opening and closing of a solenoid valve so that cold and hot water can be mixer and discharged automatically through a control switch at a desired temperature. That kind of automatic induction faucet for regulating water temperature has a single solenoid valve to do flow control. In the event that the solenoid valve malfunctions, the discharging water temperature varies. Moreover, once the regulating water temperature is set, it is fixed and cannot be altered or fine-tuned by users to meet onsite requirements.

There is another type of induction faucet to regulate water temperature. It has a handle or rotary knob outside the faucet like the conventional single handle water temperature adjusting faucet to adjust water temperature. The handle is coupled with a water intake valve inside the faucet and can control the ratio of water intake of cold and hot water so that they are mixer to reach a desired water temperature. Then a conventional induction water discharge mode is adopted to control water delivery through a solenoid valve. It is less likely to malfunction and can adjust water temperature according to user's requirement, thus is more convenient. However, the temperature regulation mechanism takes a lot of space in the faucet. As the conventional manual faucet does not have sufficient space to accommodate the automatic water temperature regulation mechanism, it requires a special design to do installation, such as including a detent means to limit swiveling of the handle on two ends to regulate the cold and hot water. Such a design involves a more complex mechanism and incurs a higher cost. Repairs and maintenance also are more difficult.

SUMMARY OF THE INVENTION

Therefore the primary object of the present invention is to solve the disadvantages of the conventional induction faucets mentioned above. The present invention provides a simpler detent apparatus for water temperature regulation of induction faucets. It is coupled with a water discharge means and can be operated steadier and fabricated and maintained easier.

In order to meet the aforesaid object, the induction faucet capable of regulating water temperature according to the invention includes a mixer located in the faucet. The mixer contains a swiveling mechanism. The swiveling mechanism includes a rotary valve and a handle located outside the mixer and the faucet. The handle is fastened to an end seat located on one end of the rotary valve through a coupling member. The detent apparatus includes a detent portion, preferably formed integrally on an outside surface of the mixer body in a protrusive manner. It has a top end surface spaced from a lower side of a bucking portion on the bottom side of the end seat of the swiveling mechanism. When the end seat is swiveled, the bucking portion hits a left bucking angle or a right bucking angle of the top end surface of the detent portion thereby the swiveling angle of the end seat is confined within a selected range.

By means of the detent apparatus set forth above, the detent portion can be directly formed on the mixer body to provide a firmed positioning and harnessing function without breaking down easily. The structure is formed in an integrated manner, thus is easier to fabricate and costs less. It overcomes the problems occurred to the conventional water temperature regulating means of induction faucets such as complex mechanism and difficult to fabricate and maintain.

The foregoing, as well as additional objects, features and advantages of the invention will be more readily apparent from the following detailed description, which proceeds with reference to the accompanying drawings.

BRIEF DESCRIPTION OF THE DRAWINGS

FIG. 2 is a fragmentary exploded view of an embodiment of the induction faucet of the invention.

DESCRIPTION OF THE PREFERRED EMBODIMENT

Figure 1:
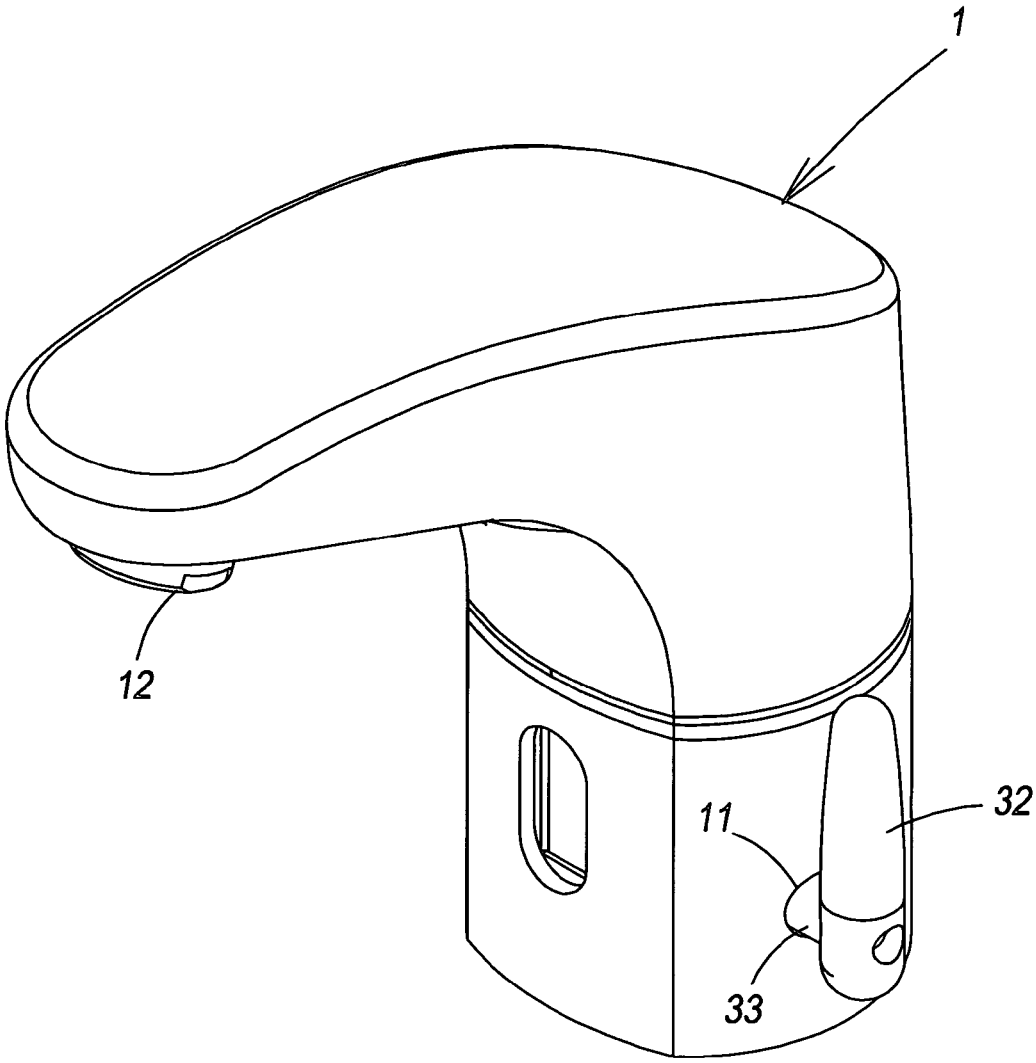
FIG. 1 is a perspective view of an embodiment of the induction faucet of the invention.
Figure 3:
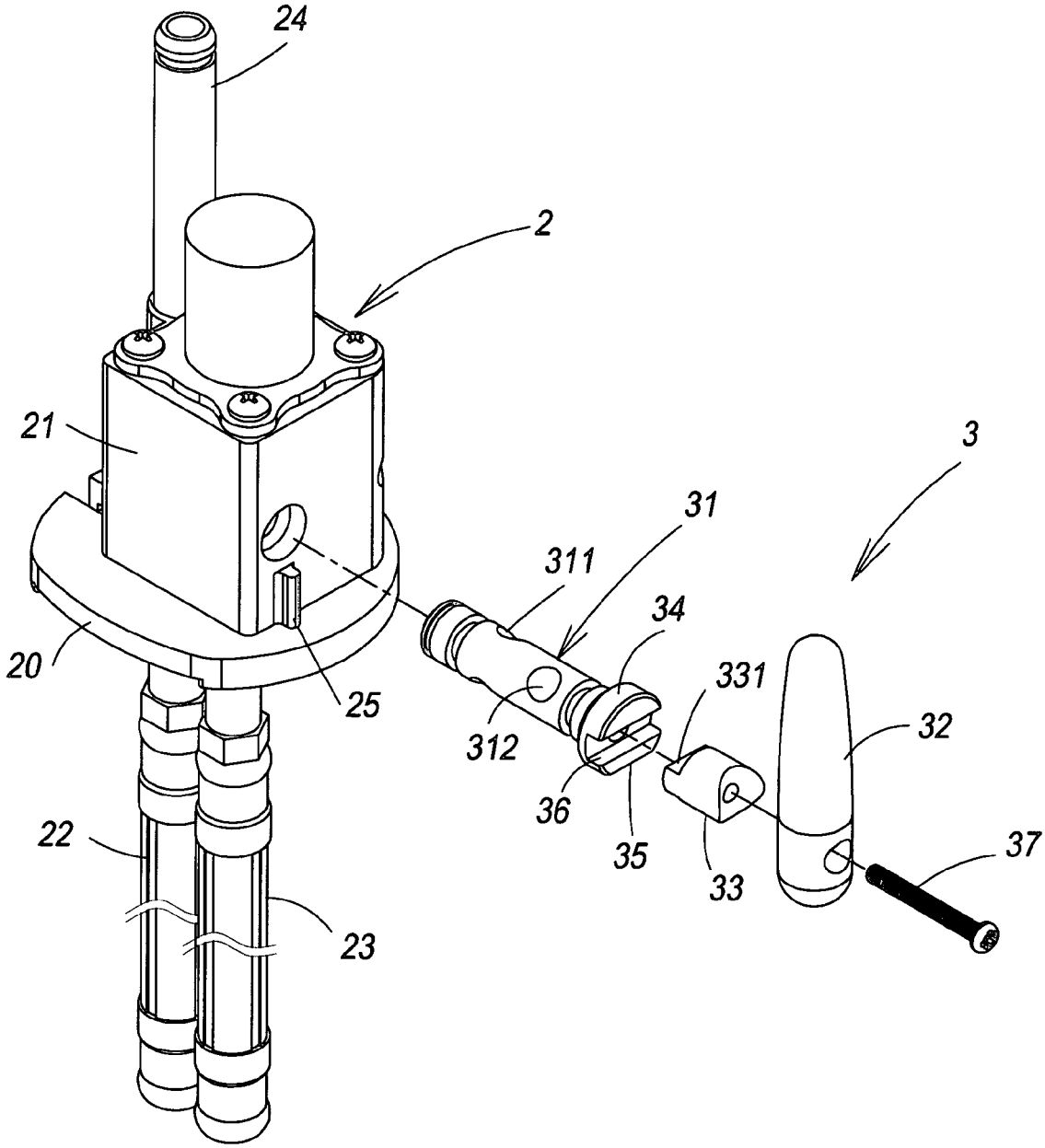
FIG. 3 is an exploded view of an embodiment of the mixer and swiveling mechanism of the invention.

Referring to FIGS. 1, 2 and 3, the detent apparatus for water temperature regulation of induction faucets of the invention includes a faucet duct 1, a mixer 2 and a swiveling mechanism 3 located in the faucet duct 1 to regulate discharge water temperature according to individual user's requirement.

The faucet duct 1 is one spout type containing an induction control mechanism. It detects users and automatically discharges water through an electromagnetic switch (not shown in the drawings). The faucet duct 1 has a body with an aperture 11 formed on the surface to be coupled with a handle 32 of the swiveling mechanism 3 such that the handle 32 is located outside the faucet duct 1 to be operated by user's hands.

The mixer 2 has a body 21 and a base 20 that are coupled together. It is located in the faucet duct 1 and coupled with a cold water intake duct 22 and a hot water intake duct 23 that are functioned cooperatively with the swiveling mechanism 3 to control water intake amount and mix the water to generate a desired water temperature. It is connected to a water discharge duct 24 of a spout 12 of the faucet duct 1 to output the water at the required temperature.

The swiveling mechanism 3 includes a rotary valve 31, the handle 32 and a coupling member 33. The rotary valve 31 is located in a hollow interior of the body 21 and has two through holes 311 and 312 of different angles corresponding to the cold and hot water intake ducts 22 and 23, and one end forming an end seat 34 which has a bucking portion 35 on one side of one end thereof. The one end of the end seat 34 has a notch 36 formed thereon corresponding to a lug 331 formed on a free end of the coupling member 33. The coupling member 33 has another free end fastened to the handle 32 through a fastening element 37 so that the rotary valve 31, handle 32 and coupling member 33 are fastened together and can be moved synchronously. The end seat 34 is extended outwards close to the outer surface of the mixer 2.

By means of the construction set forth above, the handle 32 is located outside the faucet duct 1. When a user wants to adjust the discharge water temperature, he/she swivels the handle 32 (clockwise or counterclockwise) to turn the rotary valve 31 at the same time. While the handle 32 is swiveled at varying angles, the opening sizes of the cold and hot water intake ducts 22 and 23 corresponding to the through holes 311 and 312 also alter, thereby the ratio of the cold and hot water intake can be controlled and mixed to reach the desired water temperature.

The body 21 of the mixer 2 has a detent portion 25 formed on the outer surface in a protrusive manner at a selected height. The detent portion 25 has a top end surface 255. After the swiveling mechanism 3 and the mixer 2 are assembled, the bucking portion 35 of the end seat 34 of the swiveling mechanism 3 is spaced from the top end surface 255 at a selected distance from above. The detent portion 25 is preferably integrally formed on the mixer 2.

Figure 4C:
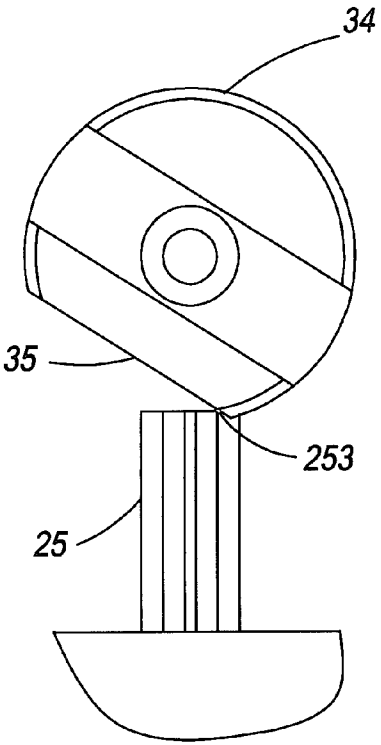
FIGS. 4A, 4B and 4C are schematic views of an embodiment of the invention showing the relationship of the end seat and the detent portion at different swiveling angles.
Figure 4B:
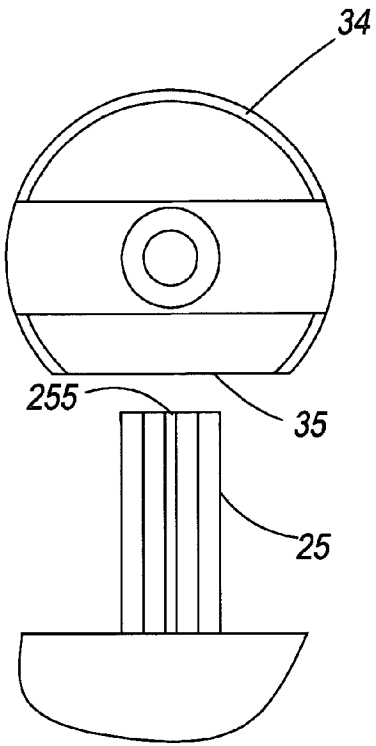
Figure 4A:
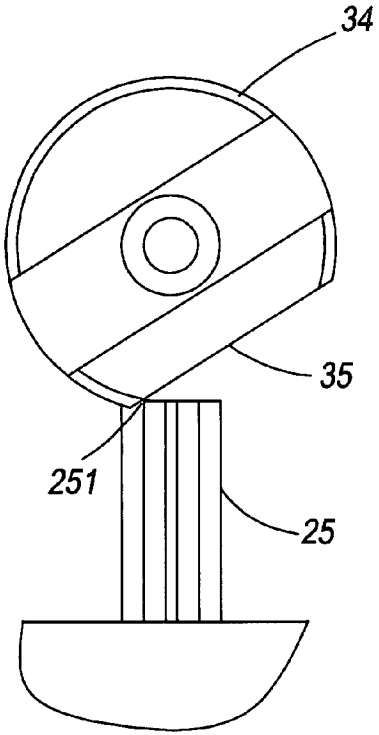

When in use, swivel the handle 32 to adjust the water temperature. The end seat 34 fastened to the coupling member 33 also is swiveled at the same time. As the end seat 34 is confined by the detent portion 25 located beneath at the selected distance, it cannot rotate a full circle. Referring to FIGS. 4A, 4B and 4C, while the end seat 34 rotates clockwise or counterclockwise, the bucking portion 35 at the bottom is inclined to hit a left bucking angle 251 (as shown in FIG. 4A) or a right bucking angle (as shown in FIG. 4C) of the detent portion 25 and reaches the rotational limit. At the two positions previously discussed, the faucet duct 1 delivers the water at the highest or lowest temperature. On the other hand, when the handle 32 is swiveled and the bucking portion 35 of the end seat 34 is in parallel with the top end surface 255 of the detent portion 25 as shown in FIG. 4B, the water temperature discharged from the faucet duct 1 is between the highest and lowest temperature. Hence according to the climate of different use areas and users' habits, the handle 32 can be swiveled to allow the bucking portion 35 to be moved to any position between the left and right bucking angles 251 and 253 of the detent portion 25 to deliver the water at a desired temperature.

While the preferred embodiment of the invention has been set forth for the purpose of disclosure, modifications of the disclosed embodiment of the invention as well as other embodiment thereof may occur to those skilled in the art. Accordingly, the appended claims are intended to cover all embodiments which do not depart from the spirit and scope of the invention.

I claim:

1. A detent apparatus for water temperature regulation of an induction faucet, comprising a mixer located in the faucet and a swiveling mechanism located in the mixer, the swiveling mechanism having a rotary valve and a handle located outside the mixer and the faucet, the handle being fastened to an end seat located on one end of the rotary valve through a coupling member, the end seat being formed in a protrusive manner close to the outer surface of the mixer; wherein the detent apparatus includes:

a detent portion which is located on the outer surface of the mixer and has a selected height and a top end surface spaced beneath a bucking portion of the end seat at a selected distance such that the end seat is swivelable and the bucking portion hits a left bucking angle or a right bucking angle of the top end surface to the detent portion so that the swiveling angle of the end seat is confined within a limited range.

2. The detent apparatus of claim 1, wherein the detent portion and the mixer are formed integrally.

* * * * *